United States Patent [19]

Wagner et al.

[11] 4,182,077

[45] Jan. 8, 1980

[54] SOLAR POWERED ELECTRIC TOY TOP

[76] Inventors: Clyde M. Wagner, 325 E. Stocker, Glendale, Calif. 91207; John H. Wagner, 1100 N. Central, Glendale, Calif. 91202

[21] Appl. No.: 853,416

[22] Filed: Nov. 21, 1977

[51] Int. Cl.[2] ..... A63H 33/26

[52] U.S. Cl. ..... 46/248; 46/269

[58] Field of Search ..... 46/248, 269, 67, 73; 273/141 A

[56] References Cited

U.S. PATENT DOCUMENTS

| | | | |
|---|---|---|---|
| 2,069,373 | 2/1937 | Kraft | 46/73 |
| 3,486,260 | 12/1969 | Ward | 46/269 |
| 3,551,709 | 12/1970 | Kemenczky | 46/269 |
| 4,090,715 | 5/1978 | Wagner et al. | 46/248 |

*Primary Examiner*—Louis G. Mancene
*Assistant Examiner*—Robert F. Cutting
*Attorney, Agent, or Firm*—Lionel L. Lucchesi

[57] ABSTRACT

A device is provided finding particular application in amusement or advertising applications, and includes an enclosure generally having a conventional beverage container shape. The enclosure includes a cylindrical structure having a first end and a second end. Means for attaching a solar cell to the first end of the enclosure includes a structure closing that end. The closing structure has a sleeve extending outwardly from it. The sleeve has a first end integrally formed with the attaching means and a second, free end. The second free end of the sleeve is adapted to receive an electrical motor. The motor includes a rotatably mounted shaft having an end extending outwardly of the enclosure. The outwardly extending end of the shaft has one of a plurality of terminations attached to it. The shaft and termination design determines the kind of movement imparted to the enclosure by the motor upon irradiation of the solar cell by a suitable source of electromagnetic energy.

8 Claims, 12 Drawing Figures

SOLAR POWERED ELECTRIC TOY TOP

BACKGROUND OF THE INVENTION

This invention relates to amusement devices, and in particular to a novel structure design having a general silhouette corresponding to a beverage container. While the invention is described in particular detail with respect to its beverage container application, those skilled in the art will recognize the wider applicability of the inventive principles disclosed hereinafter.

A number of advertising or amusement devices are known in the art which are replicas, in one form or another, of well known consumer products. Thus, it has been common to provide cylindrical waste cans resembling beverage, soft drink and intoxicating liquor or non-intoxicating beer containers. Likewise, cigarette lighters and lamps have been designed which employ beverage containers or other commercial product packages in their overall structural composition. In general, such devices are well received by the consuming public, and provide expanded brand identification for the manufacturer or producer of the product employing the package being reproduced.

The invention disclosed hereinafter may be utilized in conjunction with well known amusement or advertising novelties, but differentiates from the prior art static designs by permitting the advertising novelty to be animated. Animation is provided through the use of a solar energy conversion cell and electric motor. The motor includes a shaft extending outwardly of the enclosure. Means for causing movement of the enclosure is attached to the motor shaft. Depending upon the means attached to the motor shaft, the enclosure may be operated in a variety of movement modes including, for example, oscillatory, circular, rotational and straight line movement modes.

One of the objects of this invention is to provide a low cost, animated amusement device.

Another object of this invention is to provide an amusement device operated from a solar energy conversion cell.

Another object of this invention is to provide an animated enclosure, the motion of which is obtained directly from an electrical motor.

Other objects of this invention will be apparent to those skilled in the art in light of the following description and accompanying drawings.

SUMMARY OF THE INVENTION

In accordance with this invention, generally stated, an amusement or advertising device is provided having an enclosure. The enclosure includes means for supplying animation to the enclosure. In the preferred embodiment, the enclosure is a tubular structure having first and second ends. The enclosure is sized to receive a mounting structure which is used to mount a solar cell and a suitable electrical motor within the enclosure. The motor is electrically connected to the solar cell and includes a rotatably mounted shaft having a free end extending outwardly of the enclosure. The free end of the shaft has suitable means for imparting movement to the enclosure associated with the motor shaft-solar cell combination.

DESCRIPTION OF THE PREFERRED EMBODIMENT

Figure 1:
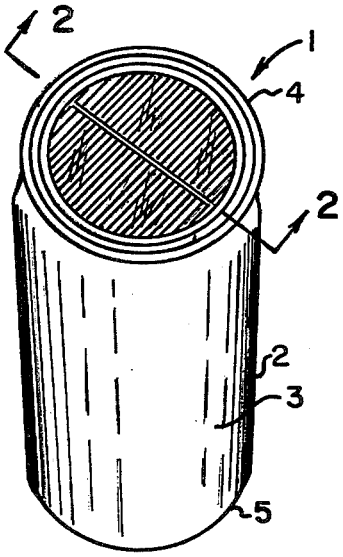
FIG. 1 is a view in perspective of one illustrative embodiment of novelty device of this invention.

Referring now to FIG. 1, reference numeral 1 indicates an amusement or display device having an elongated, tubular enclosure 2.

Figure 2:
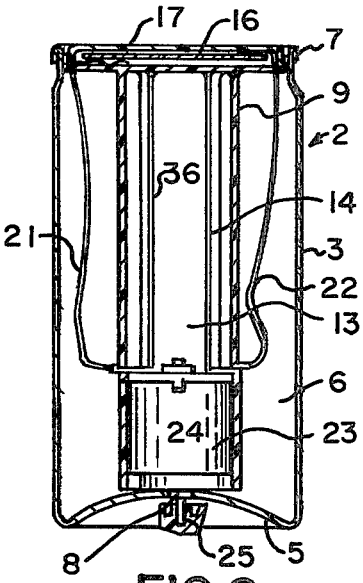
FIG. 2 is a sectional view taken along the line 2—2 of FIG. 1.

The enclosure 2, in the embodiment illustrated, generally conforms in design silhouette to a conventional beverage can container. The enclosure 2 includes a cylindrical side wall 3, a top 4 and a bottom 5. The enclosure 2 defines a cavity 6. The top 4 has a lip 7 formed about its outboard edge, and generally is open along the top 4 inboard of the lip 7. The bottom 5, best seen in FIG. 2, is arcuate or dome shaped in cross section, and has a central opening 8 formed in it.

A mounting structure 9 includes a top plate 10 and a tube 11. The tube 11, in the embodiment illustrated, is integrally formed with the top plate 10 although those parts may be manufactured separately and later attached to one another, if desired. The tube 11 extends downwardly from the top plate 10, downwardly being referenced to the drawings.

The top plate 10 includes a generally planar surface 35 having a rim 18 formed about its peripheral edge. The surface 35 and rim 18 define an annular recess 12, which is sized generally to close the top 4 of the enclosure 2. The surface 35 also has a pair of openings 19 and 20 extending through it, which are used for purposes later described in more detail.

Figure 4:
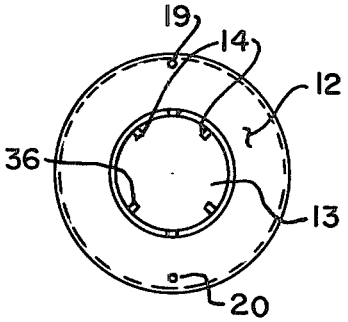
FIG. 4 is a bottom plan view thereof.
Figure 3:
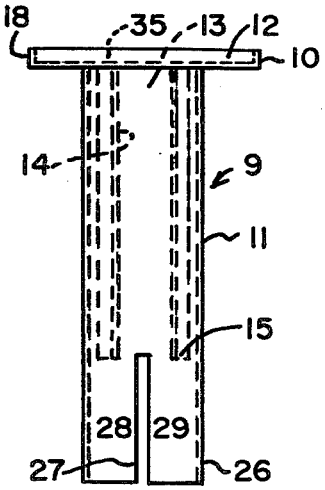
FIG. 3 is a view in side elevation of a mounting structure employed with the device of FIG. 1.
Figure 6A:
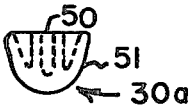
FIGS. 6*a* and 6*b* are side and plan views of a second illustrative embodiment of movement causing means compatible with the novelty device of this invention.

The tube 11 has an axial opening 13 through it. A plurality of structural supports 14 are formed internally of the opening 13 and extend generally from the end of the tube 11 adjacent the top plate 10 to some predetermined distance along the axial length of the tube 11. The supports 14 have an end face 36, best seen in FIG. 4, which define a stop 15.

The recess 12 is sized to receive a solar conversion cell 16. Solar cell 16 is conventional and various types of cells are available commercially. In general, the cell 16 converts incident light rays to electrical energy and this ability is an important in its operation of the device 1. An end cap 17 is mounted over the solar cell 16, and interlocks with the peripheral rim 18 about the recess 12 in a friction fit. Additional adhesive may be used to hold the end cap 17 to the rim 18, if desired. End cap 17 preferably is translucent, permitting passage of light rays through it to the solar cell 16. The openings 19 and 20 permit passage of a pair of electrical conductors 21 and 22. The conductors 21 and 22 are connected between the solar cell 16 and a motor 23.

Motor 3 is conventional, and generally includes a stator assembly 24 and a rotor assembly 25, not shown, but rotatably mounted with respect to the stator assembly 24 along suitable bearings at each end of the stator assembly 24. The rotor assembly includes a shaft 25 which rotates with the rotor assembly in a conventional manner.

An end 26 of the tube 11 has a plurality of slots 27 formed in it. The tube preferably is manufactured from a resilient plastic material, and the slots 27 define at least a pair of arms 28 and 29, along the end 26 of the tube 11. The slots 27 permits flexing of the tube 11 along the end 26 thereof, and enables the arms 28 and 29 to expand radially outwardly to receive the motor 23 during its insertion in the tube. The motor 24 is inserted within the opening 13 until the stator assembly 24 abuts and is frictionally engaged by the stop 15 delimited by the supports 14. Slots 24 also permit access to the motor 23 for connecting the conductors 21 and 22 to the motor 23.

The tube 11 is sized axially so that engagement of the motor 23 by the stop 15 enables the shaft 25 to extend through the opening 8 in the bottom 5 of the enclosure 2.

Figure 5A:
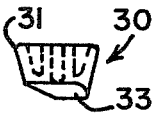
FIGS. 5*a* through 5*c* are side, elevational and plan views of one illustrative embodiment of movement causing means employed with the embodiment of FIG. 1.
Figure 5B:
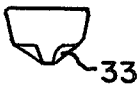
Figure 5C:
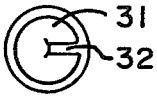

A movement causing means 30 is mounted to the shaft 25 along the free end of the shaft. In the embodiment of FIG. 2, the movement causing means 30 includes a cylindrical portion 31 having a groove 32 formed in it, best seen in FIG. 5*c*. The groove 32 permits the attachment of the movement causing means 30 on the shaft 25 in a friction fit. A lower part 33 of the cylindrical portion 31 has a V-shape in plan, as is best seen in FIG. 5*b*. The particular shape of the movement causing means 30 shown in FIG. 5*a* through 5*c* causes a rocking or oscillatory movement of the enclosure 2 upon energization of the motor 23 by the solar conversion cell 16.

Figure 7A:
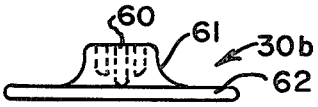
FIGS. 7*a* and 7*b* are side and top plan view of a third illustrative embodiment of movement causing means compatible with the novelty device of this invention.
Figure 6B:
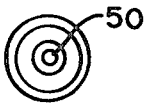
Figure 7B:
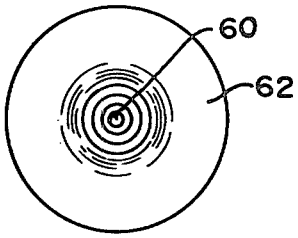

A number of other motions for the enclosure 2 may be obtained by changing the design of the movement causing means 30. Thus, a device 30*a*, shown in FIG. 6*b*, causes the enclosure 2 to move in a circular pattern on a supporting surface. in this embodiment, the movement causing means 30*a* has a central opening 50 formed in it. The opening 50 is sized to receive the shaft 25 in a friction fit. A body 51 of the means 30*a* generally has the shape of an extrados, although variations in the shape may accomplish a similar movement pattern. A movement causing means 30*b*, shown in FIGS. 7*a* and 7*b*, is designed to remain stationary on a support surface, the enclosure 2 rotating on the means 30*b*. That is to say, the means 30*b* functions as a stand for the enclosure 2. Means 30*b* also has a central opening 60 formed in a hub 61. The hub 61 is integrally formed with a platform, and the opening 60 is sized to receive the shaft 25 in a friction fit.

Rotation of the enclosure 2 is accomplished in a similar manner with each of the movement causing means described above. That is to say, irradiation of the solar cell 16 by electromagnetic energy enables the cell 16 to supply electrical energy to the motor 23. Energization of the motor 23, in turn, causes the shaft 25 to rotate in a conventional manner. Removal or blocking of the electromagnetic energy source turns the motor 23 "off."

Figure 8:
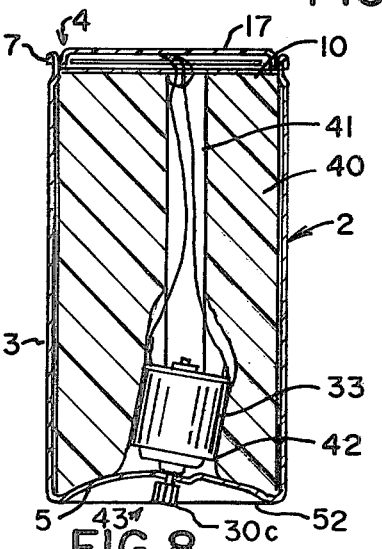
FIG. 8 is a sectional view of a second illustrative embodiment of novelty device of this invention.

Other structural forms may be utilized to mount the components of the amusement device within the cavity 44 of the enclosure 2. One such variation is shown in FIG. 8, like reference numerals being used for like purposes where appropriate. In FIG. 8, the top plate 10 and end cap 17 are supported on a core 40 having an axial opening 41 through it. Core 40 may be construction from a variety of materials, but foam type cores manufactured from materials sole under the trademark STYROFOAM work well, for example. The core 40 has a receptacle 42 formed in it, near its bottom 5. The receptacle 42 receives the motor 23 in a friction fit. The core 40 may be mounted with the enclosure 2 by any convenient method. Conventional adhesives work well, for example. The receptacle 42 also is slanted with respect to the longitudinal axis of the enclosure 2 so that the shaft 25 of the motor 23 extends outwardly of the bottom 5 at some predetermined angle.

The embodiment of FIG. 8 also utilizes a movement causing means 30*c*. The movement causing means 30*c* includes a cylindrical section 43 having a plurality of lands and grooves formed along an outer surface 44 thereof. The diameter of the cylindrical section 43 and angle of motor 23 placement enables the cylindrical section 43 to engage a lower edge 52 of the enclosure 2 on one side of the section 43, and to engage a surface or planar supporting surface, not shown, on which the device 1 may be placed, on another side of the section 43. This structural combination enables the moving causing means 30*c* to drive the enclosure 2 in a direction that includes a straight line component or linear movement component so that the enclosure travels across a planar supporting surface.

Numerous variations, within the scope of the appended claims, will be apparent to those skilled in the art in light of the foregoing description and accompanying drawings. Thus, the design silhouette of the enclosure 2 may vary in other embodiment of this invention. Although a beverage can was shown for that enclosure, the advertising value of the device 1 for a variety of enclosure designs readily becomes apparent with the knowledge imparted by this specification. Likewise, the movement causing means structure may be altered in other embodiments of this invention to vary the movement of the enclosure. Those changes may be in addition to the structural movement variations disclosed herein. While particular materials were described as preferred, other materials may be utilized or substituted for those described. These variations are merely illustrative.

Having thus described the invention, what is claimed and desired to be secured by Letters Patent is:

1. An amusement device, comprising:

an enclosure, said enclosure having a top, a longitudinal length, and a bottom wall;

a solar cell mounted along said top;

an electrical motor mounted within said enclosure and electrically connected to said solar cell, said electrical motor including a shaft extending outwardly of said enclosure;

means for mounting said solar cell to said enclosure along the top thereof, said means for mounting said solar cell in said enclosure comprises a core, said core having a first end supporting said solar cell, and a second end, said second end having a receptacle formed in it for receiving said motor; and means attached to the shaft of said motor for causing movement of said enclosure.

2. An amusement device, comprising:

an enclosure, said enclosure having a top, a longitudinal length, and a bottom wall;

a solar cell mounted along said top;

an electrical motor mounted within said enclosure and electrically connected to said solar cell, said electrical motor including a shaft extending outwardly of said enclosure;

means for mounting said solar cell to said enclosure along the top thereof, said means for mounting said solar cell including a sleeve having a receptacle formed on one end thereof for receiving said solar cell, said sleeve including a tubular structure having a first end attached to said receptacle and a free second end, said second end having a plurality of slots formed in it, said slots permitting insertion of said motor internally of said sleeve; and means attached to the shaft of said motor for causing movement of said enclosure.

3. The device of claim 2 wherein said sleeve further has a plurality of strenghtening ribs formed with it, said ribs being sized to engage said motor in the intermounted position thereof.

4. The device of claim 3 wherein said enclosure has a bottom wall, said shaft extending through said bottom wall.

5. The device of claim 4 wherein said movement causing means is a cylindrical structure, the rotation of said movement causing means by said motor causing said enclosure to move in a circular orbit.

6. The device of claim 4 wherein said movement causing means comprises a circular base and means for receiving a shaft formed integrally with said base, said base supporting said enclosure and permitting rotation of said enclosure about said base.

7. The device of claim 4 wherein said movement causing means is a cylindrical structure having an outer surface formed in a plurality of lands and grooves formed therein, rotation of said means causing said enclosure to move in a direction having a linear component of movement.

8. The device of claim 1 wherein said movement causing means is a cylindrical structure having an outer surface formed in a plurality of lands and grooves formed therein, rotation of said means causing said enclosure to move in a direction having a linear component movement.

* * * * *